US006177624B1

(12) United States Patent
Takahashi et al.

(10) Patent No.: US 6,177,624 B1
(45) Date of Patent: Jan. 23, 2001

(54) ARRANGEMENT APPARATUS BY MODIFICATION OF MUSIC DATA

(75) Inventors: Makoto Takahashi; Yoshihisa Ito, both of Hamamatsu (JP)

(73) Assignee: Yamaha Corporation, Hamamatsu (JP)

( * ) Notice: Under 35 U.S.C. 154(b), the term of this patent shall be extended for 0 days.

(21) Appl. No.: 09/366,394

(22) Filed: Aug. 3, 1999

(30) Foreign Application Priority Data

Aug. 11, 1998 (JP) ..... 10-226731

(51) Int. Cl.[7] ..... A63H 5/00; G04B 13/00; G10H 7/00

(52) U.S. Cl. ..... 84/609; 84/634; 84/649

(58) Field of Search ..... 84/609, 611, 634, 84/649, 650

(56) References Cited

U.S. PATENT DOCUMENTS

| | | | | |
|---|---|---|---|---|
| 4,646,609 | | 3/1987 | Teruo et al. . | |
| 5,092,216 | | 3/1992 | Wadhams . | |
| 5,220,119 | | 6/1993 | Shimada . | |
| 5,331,112 | * | 7/1994 | Sato et al. | 84/609 |
| 5,561,256 | | 10/1996 | Aoki et al. . | |
| 5,606,144 | * | 2/1997 | Dabby | 84/609 |
| 5,744,740 | | 4/1998 | Mizuno . | |
| 5,962,802 | * | 10/1999 | Iizuka | 84/609 |
| 5,990,407 | * | 11/1999 | Gannon | 84/613 |

FOREIGN PATENT DOCUMENTS

| | | |
|---|---|---|
| 0 288 800 | 11/1988 | (EP) . |
| 2-131292 | 5/1990 | (JP) . |
| 5-073036 | 3/1993 | (JP) . |

* cited by examiner

*Primary Examiner*—Jeffrey Donels
(74) *Attorney, Agent, or Firm*—Morrison & Foerster

(57) ABSTRACT

In a music arrangement apparatus, a music data block provides a time-series of music data which contains at least a pitch component and which can be sequentially processed to produce a music performance. An arrangement data block provides a time-series of arrangement data in correspondence to the time-series of the music data. A modifying block modifies at least the pitch component of the music data according to the arrangement data so as to arrange at least a melody of the music performance. Further, a selecting block selects one or more of segments of the arrangement data, and a setting block sets the selected segment of the arrangement data.

12 Claims, 5 Drawing Sheets

ARRANGEMENT APPARATUS BY MODIFICATION OF MUSIC DATA

The present invention generally relates to a music arrangement apparatus or performance information converting apparatus and a computer readable medium recording a performance information conversion control program, which are suitable for automatically playing performance information associated with an automatic pattern while changing music tone elements or components such as a sounding timing, a gate time or duration, and a velocity.

Conventionally, the performance information converting techniques of the above-mentioned type are applied to automatic backing or accompaniment and automatic performance. One example is an automatic backing apparatus. In this apparatus, music data is read from automatic backing pattern data stored in a memory, and elements or components of this music data such as sounding timing, gate time (sound sustaining time), and velocity (or volume) are changed. On the basis of these changed elements, automatic backing sounds are generated. This operation provides a backing or accompaniment having a different atmosphere from that obtained by directly reproducing original music pattern data as it is. In a simple technique, the music performance is executed based only on the music pattern data, hence only monotonous performance determined by the music pattern data is reproduced. On the other hand, in the above-mentioned technique, performance information conversion or music arrangement is made to add or introduce a subtle drive or a sense of groove (or musician-unique mannerisms) to the reproduced performance.

Change information or arrangement data used for changing music tone elements has generally a length comparable to the backing pattern data, for example two measures. Further, the change information contains the arrangement data for specifying variables such as sounding timing, gate time, and velocity except for pitch. The arrangement data is read sequentially in step by step along with the reading of the music data from music pattern data. Each music element is changed or modified according to the arrangement data. This change information can be created and edited as required by the user. However, the melody of the music cannot be arranged.

However, with the conventional automatic backing apparatus, the change information can be edited only when the music performance is in the stopped state. The change information is edited in a so-called step manner such that each value of the arrangement data of the change information is displayed on an indicator or monitor, and the displayed value is incremented or decremented by operating a switch or a numeric key.

During the music performance, the change information selected at the start of the performance is used repeatedly, so that the same music performance repeats every predetermined length, resulting in lack of variety and therefore resulting in a monotonous performance. It should be noted that the monotonousness due to repetition could be resolved by creating a relatively long span of the change information but at the expenses of time and labor.

SUMMARY OF THE INVENTION

It is therefore an object of the present invention to provide a wide variety of musical performance with a simple operation in a performance information converting apparatus or music arrangement apparatus by varying time-series of the components of the music data constituting performance information on the basis of time-series of the arrangement data constituting change information.

In carrying out the invention and according to one aspect thereof, there is provided a music arrangement apparatus comprising a music data block that provides a time-series of music data which can be sequentially processed to produce a music performance, an arrangement data block that provides a time-series of arrangement data in correspondence to the time-series of the music data, and a modifying block that modifies at least the pitch component of the music data according to the arrangement data so as to arrange at least a melody of the music performance.

According to the music arrangement apparatus constituted as above, the pitch component may be changed in the same manner as other components so as tempo, rhythm, volume and duration of tones, such that a melody itself included in the performance information may be changed, and a sense of groove based on the pitch change may be obtained. Consequently, the novel constitution allows the user to make a wide variety of music performance with a simple operation.

In carrying out the invention and according to another aspect thereof, there is provided a music arrangement apparatus comprising a music data block that provides a time-series of music data which contains at least a pitch component and which can be sequentially processed to produce a music performance, an arrangement data block that provides a time-series of arrangement data in correspondence to the time-series of the music data, the arrangement data being divided into a sequence of segments, a modifying block that modifies the music data according to the arrangement data so as to arrange the music performance, a selecting block that selects one or more of the segments of the arrangement data, and a setting block that sets the selected segment of the arrangement data.

According to the music arrangement apparatus constituted as above, any segment may be specified by the segment selecting block, and the arrangement data of the specified segment may be set by the arrangement data setting block. Consequently, the novel constitution allows the user to simply set the arrangement data of any segment, thereby producing a wide variety performance with a simple operation.

Preferably, in the music arrangement apparatus, the selecting block can select a group of consecutive segments at once. By such a manner, a plurality of segments may be simultaneously specified, thereby allowing the user to make a wider variety of performance with a simple operation.

Preferably, the music arrangement apparatus further comprises a display block that displays the selected group of the consecutive segments such as to enable the setting block to visually edit and set the arrangement data. Therefore, the setting state of the specified segments of the arrangement data may be displayed for easier operation.

Preferably, the music arrangement apparatus further comprises a generating block that sequentially processes the modified music data so as to generate a sound of the music performance. In such a case, the setting block can be manually operated even during the generating of the sound for editing the arrangement data so that the melody of the music performance is instantly rearranged during the generating of the sound. By such a manner, the sound elements may be changed real-time in the performance reproduction based on the arrangement data of the performance information, thereby allowing the user to make a wider variety of the music performance.

In carrying out the invention and according to yet another aspect thereof, there is provided a computer readable medium for use in a computer having a central processor and a memory. The medium contains program instructions executable by the central processor for causing the computer to perform a music arrangement process. The music arrangement process comprises the steps of preparing a time-series of music data in the memory, the music data being composed of at least, a pitch component and being sequentially processable to produce a music performance, preparing a time-series of arrangement data in correspondence to the time-series of the music data, and modifying at least the pitch component of the music data according to the arrangement data so as to arrange at least a melody of the music performance. Executing such a performance information conversion control program provides the same effects as those provided by the music arrangement apparatus.

In carrying out the invention and according to a different aspect thereof, there is provided a computer readable medium for use in a computer having a central processor and a memory. The medium contains program instructions executable by the central processor for causing the computer to perform a music arrangement process. The music arrangement process comprises the steps of preparing a time-series of music data in the memory, the music data being sequentially processable to produce a music performance, preparing a time-series of arrangement data in correspondence to the time-series of the music data, the arrangement data being divided into a sequence of segments, selecting one or more of the segments of the arrangement data, setting the selected segment of the arrangement data, and modifying the music data according to the arrangement data so as to arrange the music performance. Executing such a performance information conversion control program provides the same effects as those provided by the inventive music arrangement apparatus.

DETAILED DESCRIPTION OF EMBODIMENTS

This invention will be described in further detail by way of example with reference to the accompanying drawings. One embodiment of the invention will be outlined as follows. A music sequencer incorporating a tone generator has a normal mode and a pattern mode. In the normal mode, song data (song performance information) is reproduced for automatic performance of a desired music song. In the pattern mode, music pattern data (backing pattern performance information) is reproduced for automatic backing or automatic accompaniment. Also, in the pattern mode, the music pattern data is changed or modified by arrangement pattern data (change information) to provide arranged automatic backing with a variety of performance. Therefore, the following mainly describes the automatic backing in the pattern mode. The music pattern data and the arrangement pattern data are each two measures long (in four-four time). A segment obtained by dividing the two measures by 16 is referred to as a "grid." Namely, one grid is equivalent to one segment in units of an eighth note.

In the present embodiment, components of the music pattern data include a pitch (pitch information), a sounding timing, a gate time, and a velocity. The arrangement pattern data is constituted by a time-series of variables corresponding to these components. In addition, the music pattern data is composed of plural tracks corresponding to plural parts of the backing accompaniment. The arrangement pattern data is also composed of plural tracks so that each track of the arrangement pattern data corresponds to each track (except for a rhythm track) of the music pattern data. Each variable can be set and modified on a grid basis for each track.

Figure 1:
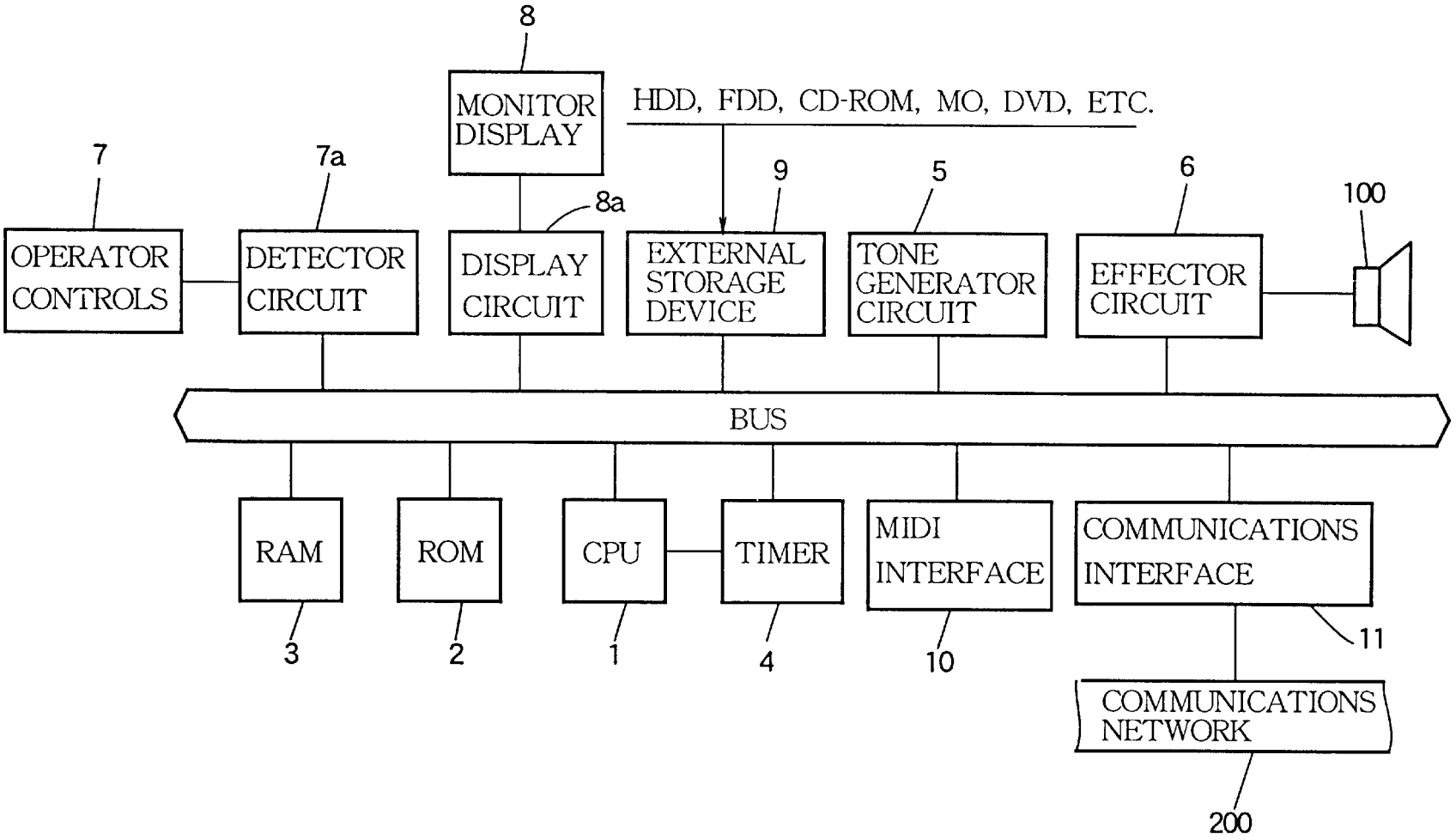
FIG. 1 is a block diagram illustrating a tone-generator built-in sequencer to which the music arrangement apparatus according to the invention is applied.

FIG. 1 is a block diagram illustrating a tone-generator built-in sequencer to which the music arrangement apparatus according to the invention is applied. In the figure, a CPU (central processing unit) 1 controls the entire system on the basis of a control program stored in a ROM 2 by use of a work area of a RAM 3. The RAM 3 stores song data, music pattern data, arrangement pattern data, and so on. The RAM 3 has a variables buffer for storing variables for each track and each grid of the arrangement pattern data. It should be noted that the RAM 3 is backed up by a battery, and therefore the above-mentioned music pattern data and the arrangement pattern data are retained even when the power to the system is turned off.

The CPU 1 sets a tempo prescribed by the music pattern data or a user-specified tempo to a timer 4. On the basis of the tempo, the timer 4 generates a clock signal (a tempo clock). The CPU 1 causes an interrupt for each clock signal to process either of automatic backing and automatic performance. It should be noted that the number of clocks equivalent to one quarter note is 48 and one measure in four—four time is 192 clocks.

In the automatic backing process, the clock signal is counted to provide timing of sequentially reading values of the music pattern data and variables of the arrangement pattern data, respectively. These values of the music pattern data are changed or modified on the basis of the variables of the arrangement pattern data. The changed results are sent to a tone generator circuit 5 along with a note-on/note-off message.

The tone generator circuit 5 can generate a plurality of sounds through plural channels at a time. Each sound has a predetermined timbre set in a corresponding music pattern data track. The tone generator circuit 5 generates the sounds characterized by the pitch, note-on, and velocity set by the CPU 1. The sound signal generated by the tone generator circuit 5 is imparted with various effects in an effector circuit 6. The resultant sound signal is sounded by a sound system 100. Setting a note-off to a sounding channel dampens or stops the sound signal, which is muted.

An operator controls 7 include various switches disposed on an operator panel as will be described later. The CPU 1 captures input commands from the various switches of the operator controls 7 via a detector circuit 7*a* to execute processing accordingly.

A monitor display 8 is arranged on the operator panel and is made up of a liquid crystal panel, for example. When the CPU 1 outputs graphic data to a display circuit 8*a*, the monitor display 8 visually indicates the data.

An external storage device 9 is composed of a hard disk drive (HDD), a floppy disk drive (FDD), a CD-ROM drive, a magneto-optical disk drive (MO), or a digital versatile disk drive (DVD), and may be used to input and store pattern data for automatic accompaniment and song data for automatic performance. A MIDI interface (I/F) 10 transfers pattern data and song data with an externally attached MIDI device. A communications interface 11 is connected to a communications network 200 to receive various data such as pattern data and song data from a server computer, for example.

The sequencer shown in FIG. 1 incorporates a music arrangement apparatus basically comprised of a music data block implemented by RAM 3 that provides a time-series of music data which contains at least a pitch component and which can be sequentially processed to produce a music performance, an arrangement data block also implemented by RAM 3 that provides a time-series of arrangement data in correspondence to the time-series of the music data, and a modifying block implemented by CPU 1 that modifies at least the pitch component of the music data according to the arrangement data so as to arrange at least a melody of the music performance.

Figure 2:
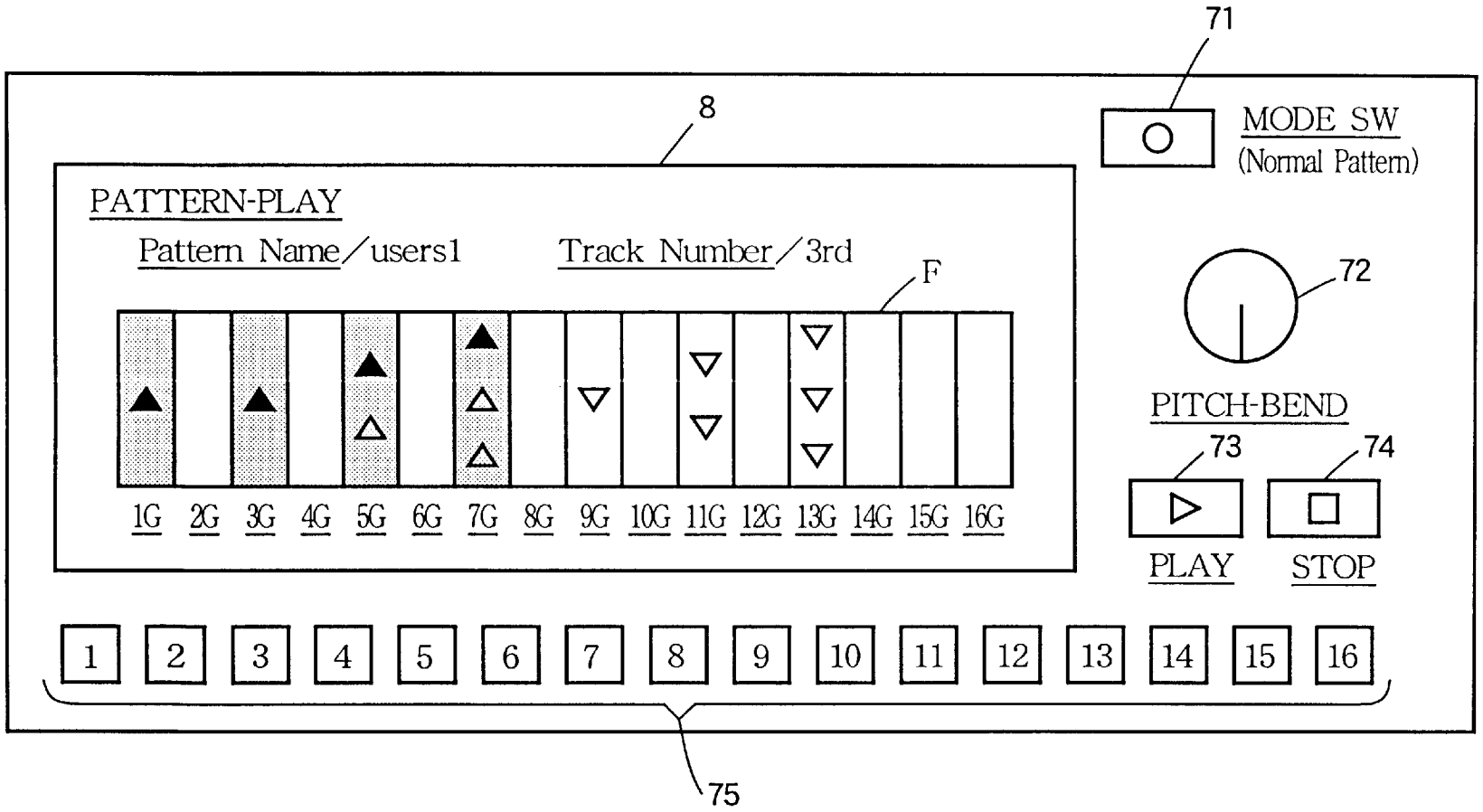
FIG. 2 is a diagram illustrating an operator panel of the embodiment of the invention.

FIG. 2 illustrates the operator panel, in which an operation associated with pitch variable setting is mainly shown, other variables setting associated with sounding timing, gate time, and velocity being omitted. The operator controls 7 have a mode switch 71 for switching between the normal mode and the pattern mode, a pitch bend knob 72 for inputting a pitch variable, a play switch 73 for starting the reproduction of automatic accompaniment or automatic performance, a stop switch 74 for stopping the automatic accompaniment or the automatic performance, and a plurality of grid selector switches 75 for grid selection. In addition, switches (not shown) for inputting the variables of components other than the pitch are provided. It should be noted that the grid switches 75 are also shared to select the grids of other components than the pitch.

Some sequencers have keyboard-like switches arranged like black and white keys of a piano for use in an step input or real time input of song data or pattern data, and pad keys for use in rhythm part inputting. In such a case, the grid selector switches 75 of the present embodiment are assigned to 16 switches corresponding to the white keys in the keyboard-like switches. It should be noted that the switches corresponding to black keys are omitted from FIG. 2.

When a pitch variable for example is inputted in the pattern mode, a graphic pattern shown in FIG. 2 is presented on the monitor display 8. Namely, the pattern name of the currently selected music pattern data is indicated as "users1" in a label "Pattern Name/users1" and the track number of the currently selected track of that music pattern data is indicated as "3rd" in a label "Track Number/3rd." Further, 16 grids corresponding to the length of the music pattern data are indicated in a grid frame F which is a kind of a graphic pattern and which is consisting of 16 grids. The settings of the pitch variables or pitch shifts of the currently selected track are graphically presented in this grid frame F.

To be more specific, the pitch variable is read from the track of the arrangement pattern data corresponding to a track of the selected music pattern data, from the variables buffer in the RAM 3. The read pitch variable data is indicated with a triangle marker in a grid for which the pitch change is specified. It should be noted that one triangle marker is equivalent to one half-tone. A normally standing triangle marker indicates an upward pitch shift while a headstand triangle marker indicates a downward pitch shift. A white triangle marker indicates a variable that was set in the past while a black triangle marker indicates a variable that is set this time. Further, for the components other than the pitch, a similar graphic pattern indicative of a grid frame and a corresponding variable may be alternatively displayed on the monitor display 8.

As described above, in the inventive music arrangement apparatus, a music data block implemented by RAM 3 provides a time-series of music data which contains at least a pitch component and which can be sequentially processed to produce a music performance. An arrangement data block also implemented by RAM 3 provides a time-series of arrangement data in correspondence to the time-series of the music data. The arrangement data is divided into a sequence of segments. A modifying block implemented by CPU 1 modifies the music data according to the arrangement data so as to arrange the music performance. A selecting block implemented by the operating controls 7 selects one or more of the segments of the arrangement data. A setting block also implemented by the operating controls 7 sets or edits the selected segment of the arrangement data. Preferably, the selecting block can select a group of consecutive segments at: once. Further, a display block composed of the display monitor 8 displays the selected group of the consecutive segments such as to enable the setting block to visually edit and set the arrangement data. Still further, a generating block composed of the tone generator circuit 5 sequentially processes the modified music data so as to generate a sound of the music performance. In such a case, the setting block can be manually operated even during the generating of the sound for editing the arrangement data so that the melody of the music performance is instantly rearranged during the generating of the sound.

Figure 3:
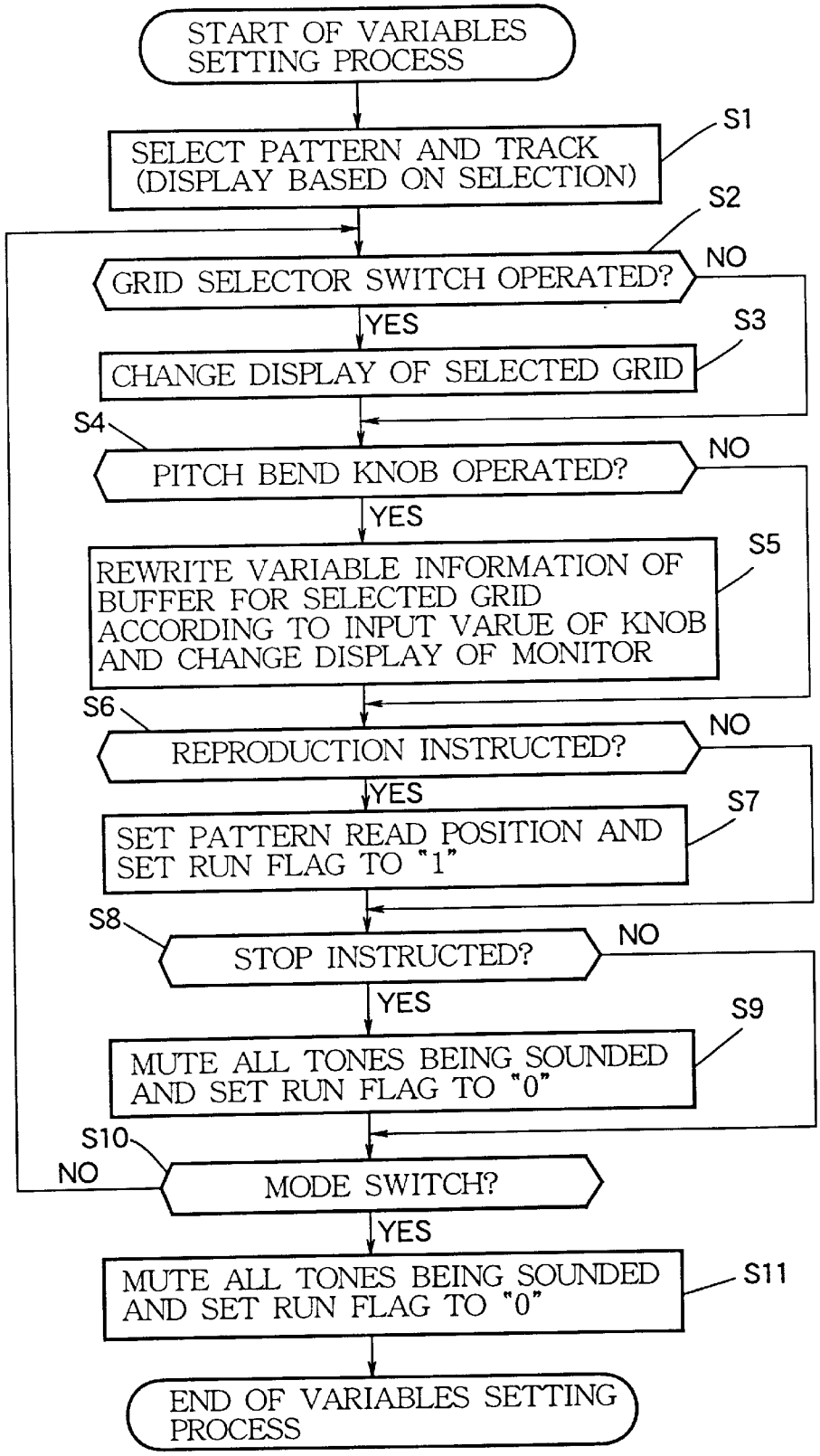
FIG. 3 is a flowchart of pitch variables setting process executed in the embodiment of the invention.
Figure 4:
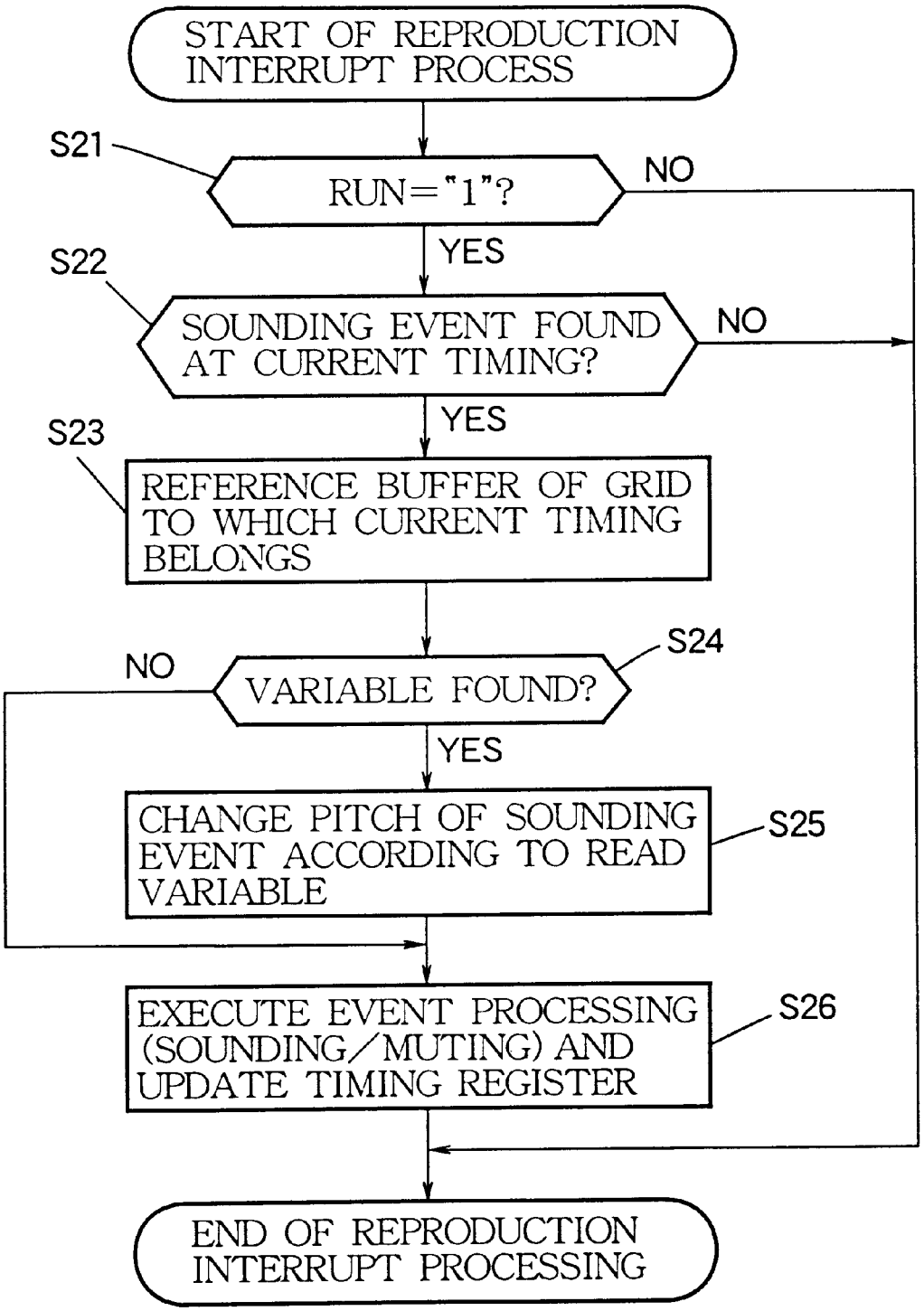
FIG. 4 is a flowchart of reproduction interrupt process executed in the embodiment of the invention.

It should be noted that the changing of the pitch and the changing of other components are only different in types of the data to be handled and the required processing operations are basically the same. Therefore, the following mainly describes the changing of the pitch component as an example. FIG. 3 is a flowchart of the pitch variables setting process executed in the present embodiment, which is one example of a performance information conversion control program according to the invention. FIG. 4 is a flowchart of reproduction interrupt process. The operations of the embodiment will be described with reference to these flowcharts. It should be noted that the description of the main flow process will be omitted from the following description because the main flow process is an ordinary and regular one. The pitch variables setting process shown in FIG. 3 is a subroutine called when the pattern mode is entered by operating the mode switch 71 in the main-flow process.

It should be noted that, in these processing operations, a counter register set in the RAM 3 is used to point read positions of data, indicated by clock values within two measures of the music pattern data and the arrangement pattern data. Namely, this counter register increments the count value every time a reproduction interrupt is caused and is reset upon counting two measures (for 192 clocks). The count value upon stopping or suspending of the automatic backing is held in another register in the RAM 3. When the automatic backing restores to start again, the count value held in that register is set to the counter register, thereby updating the read position.

In the pitch change setting process shown in FIG. 3, music pattern data of a desired song and a target track thereof are selected in step S1, upon which the pattern number of the selected pattern, the track number of the selected track, the grid frame F corresponding to that track, and the settings (indicated by triangle markers) of the pitch variables in the grid frame F are displayed on the monitor display 8.

In step S2, it is determined whether a grid select switch 75 has been operated or not. If the decision is NO, the processing goes to step S4. If the decision is YES, the display of the grid corresponding to the grid selector switch 75 operated in step S3 is changed, upon which the processing goes to step S4. In this grid display change processing, if the grid corresponding to the operated grid selector switch 75 has not been selected at the time, the corresponding grid in the grid frame F is displayed in dot shadings (refer to FIG. 2) as newly selected one; if the grid has been already selected, the dot shadings of the grid in the grid frame F is chanted to a plain appearance as non-selected one.

Next, in step S4, it is determined whether the pitch bend knob 72 has been operated or not. If the decision is NO, the processing goes to step S6. If the decision is YES, the pitch variable in the variables buffer corresponding to the grid being selected is rewritten according to the input from the pitch bend knob 72 in step S5. At the same time, the display of the corresponding setting (as indicated with a triangle marker) is updated in the selected grid indicated in the grid frame F, upon which the processing goes to step S6.

In step S6, it is determined whether reproduction has been instructed or not with the play switch 73. If the decision is NO, the processing goes to step S8. If the decision is YES, the read positions of the music pattern data and the arrangement pattern data are set to the counter register in step S7 and, at the same time, a RUN flag provided in the RAM 3 is set to "1", upon which the processing goes to step S8. It should be noted that, in setting the read positions, the read position is set to the beginning of the music pattern data for a first instruction of the reproduction after power-on sequence. Otherwise, the read position is set to the last position at which the automatic backing occasionally stops in response to a second instruction of the reproduction after the stopping of the automatic backing.

In step S8, it is determined whether the stop of the music performance has been instructed with the stop switch 74. If the decision is NO, the processing goes to step S10. If the decision is YES, the tones being sounded are all muted and the RUN flag is set to "0". Then, the current read position is stored (the corresponding value on the counter register is saved) in step S9. Then, the processing goes to step S10.

In step S10, it is determined whether an instruction for mode switching has been made with the mode switch 71. If the decision is NO, then the processing goes back to step S2 and the above-mentioned processing operations are repeated. If the decision is YES, the tones being sounded are all muted and the RUN flag is set to "0" in step S11, upon which the pitch variables setting process comes to an end, thereby returning to the main flow routine.

Thus, in the pattern mode, simple operating of the grid selector switch 75 for the selected track always allows the user to select any number of grids, and to set the pitch variables to the selected grids by operating the pitch bend knob 72. In addition, when the RUN flag goes "1" after issuing an instruction for automatic backing reproduction with the play switch 73, the automatic performance is executed according to the pitch variables of the grids by the reproduction interrupt as will be described later.

As described above, the inventive music arrangement method is carried out by the steps of providing a time-series of music data, which is composed of at least a pitch component and which can be sequentially processed to produce a music performance, providing a time-series of arrangement data in correspondence to the time-series of the music data, and modifying at least the pitch component of the music data according to the arrangement data so as to arrange at least a melody of the music performance. Preferably, the arrangement data indicates a shift of the pitch component of the music data so that the step of modifying shifts the pitch component of the music data as indicated by the arrangement data to thereby modify the music data.

In another aspect of the invention, the music arrangement method is carried out by the steps of providing a time-series of music data, which can be sequentially processed to produce a music performance, providing a time-series of arrangement data in correspondence to the time-series of the music data, the arrangement data being divided into a sequence of segments, selecting one or more of the segments of the arrangement data, setting the selected segment of the arrangement data, and modifying the music data according to the arrangement data so as to arrange the music performance.

The reproduction interrupt process shown in FIG. 4 is caused 48 times per quarter note by the clock signal supplied from the timer 4. In step S21, it is determined whether the RUN flag is "1" or not. If the decision is NO, the original main routine is reentered. If the decision is YES, then, in step S22, the music pattern data is checked as for a sound/mute event at the current timing indicated by the count value on the counter register. If no sound/mute event is found, the original routine is reentered. If a sound/mute event is found, the variables buffer of the grid to which the current timing belong is referenced in step S23.

In step S24, the variables buffer is searched for a valid pitch variable (other than "0"). If the decision is NO, the processing goes to step S26. If the decision is YES, the pitch of the sounding event or note-on event is modified according to the pitch variable to obtain the modified pitch data in step S25. In step S26, in the case of sounding event, the modified pitch data and the corresponding note-on message are outputted to the tone generator circuit 5. In the case of muting event, a note-off message is sent to the tone generator circuit 5. The sounding or muting event processing is thus executed. At the same time, the value of the counter register is updated, or reset at the end of two measures, and the main routine is reentered. It should be noted that the sounding or muting event processing is executed for each track.

Thus, the music pattern data is changed according to the pitch variable or pitch shift specified by the arrangement pattern data, thereby sounding a tone. This reproduction interrupt process can be caused by an interrupt signal even during the pitch variables setting process shown in FIG. 3. In such a case, when the pitch variable is rewritten by the pitch variables setting process, the automatic backing with the rewritten pitch variable reflected is provided instantly. Namely, because the pitch of a sound can be changed real time during the automatic backing, a wide variety of performance is provided. In addition, because any grid can be selected by operating the plural grid selector switches 75 corresponding to the grids, the variables can be inputted extremely simply.

Figure 5:
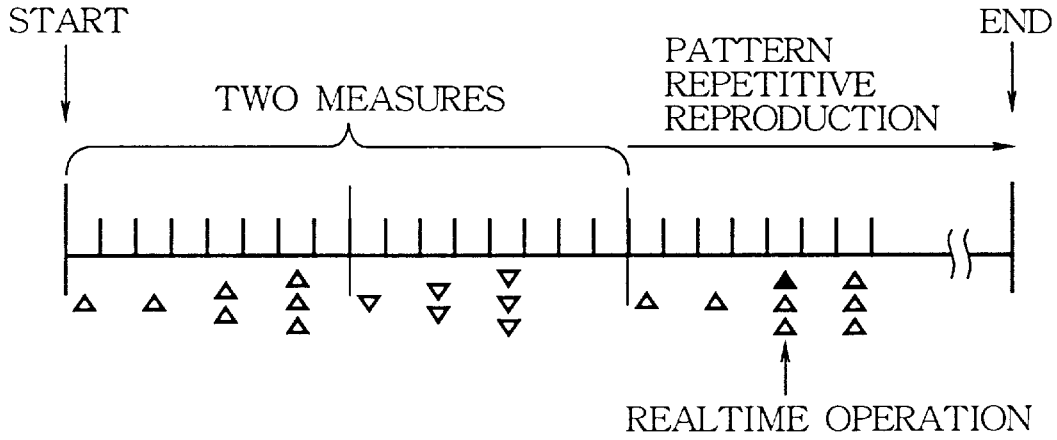
FIG. 5 is a schematic diagram illustrating an example of music performance produced in the embodiment of the invention.

FIG. 5 schematically illustrates an example of music performance, which corresponds to a situation in which the pitch variables are set as shown in FIG. 2. First, when the automatic backing starts, the pitch is changed a half tone up in the first grid. Then, the pitch is changed a half tone up again in the third grid. Next, in the fifth and seventh grids, the pitch is changed one tone up and one and a half tone up, respectively, thereafter entering the second measure. In the second measure, the pitch is changed a half tone down in the ninth grid, a half tone down in the eleventh grid, and one and a half tone down in the thirteenth grid. From the third measure, the music pattern data and the arrangement pattern data are reproduced repeatedly. In this example, before entering the fifth grid of the third measure for example, if the pitch is changed a half tone further up in the fifth grid during the automatic backing, the pitch that was half tone up in the fifth grid of the first measure is changed a half tone up for reproducing the fifth grid of the third measure. This indicates that the pitch can be changed real time even during the automatic backing by editing the arrangement pattern data.

In the above-mentioned processing, the read positions of the music pattern data and the arrangement pattern data are saved when the automatic backing is momentarily stopped, and a next automatic backing operation restarts from the saved read position. It will be apparent that the saved read position may be reset to the beginning of the music pattern data by operating a cue switch for example, thereby restarting the reproduction from the beginning of the music pattern data.

The conventional techniques of changing or arranging music pattern data on the basis of change information (the arrangement pattern data) have no pitch changing capability mentioned above. The novel technique can change the melody of the automatic backing by the pitch changing as in the above-mentioned embodiment, thereby providing a wide variety of performance forms. In the above-mentioned embodiment, the pitch changing is made on a half tone step basis. It will be apparent that, if the pitch is varied continuously, the user can have a way of playing such as bending, thereby providing a wider variety of sense of groove.

In the above description, the pitch change has been conducted as an typical example. It will be apparent that the change in sounding time, gate time, and velocity may be conducted in a similar manner. The change in these factors further provides a sense of groove and so on, thereby allowing the user to play in a wider variety of ways.

It should be noted that the sounding timing and the muting timing which is determined by combination of the sounding timing and a gate time can be modified on the basis of the timings changed with the sounding timing and gate time variables at testing for a sounding/muting time with the current timing as shown in step S22.

It should also be noted that a sounding timing variable is generally small as compared with the length of a note. In order to execute the change processing in a situation where a sounding timing is included in the preceding grid by the change done, a next grid may also be referenced when referencing the grid included in the current timing by way of example to check the next grid for a sounding event with current timing.

It will be apparent that the lengths of the music pattern data, the arrangement pattern data, and the number of grids may not necessarily be limited to those of the above-mentioned embodiment. In the above-mentioned embodiment, a grid may be selected during the automatic backing, the variable being set real time for the selected grid. It will be apparent that the arrangement pattern data may be created real time along with the automatic backing by displaying the position of currently performed automatic backing in the grid frame and by storing the variable along with timing data by the input operation at that moment without grid selection. Determining for each song or each track as to whether the arrangement pattern data is to be used during the music pattern data reproduction provides a wider variety of performance.

In the above-mentioned embodiment, the changing of the music pattern data has been described as an example. It will be apparent that song data for automatic performance may be changed on the basis of the arrangement pattern data. Further, the change processing may be executed for the performance based on user-operated keyboard or the arpeggio performance based on arpeggio capability.

In the above-mentioned embodiment, the music pattern data and the arrangement pattern data are loaded in the RAM 3, and the performance information conversion control program is stored in the ROM 2. It will be apparent that the music pattern data, the arrangement pattern data and the performance information conversion control program may be stored on a CD-ROM for example. These data and the program may be loaded onto the hard disk (HD) from the CD-ROM drive. The CPU 1 develops the performance information conversion control program on the HD into the RAM 3 and, on the basis of the program in the RAM 3, controls the operation of the system in a manner similar to that of the above-mentioned embodiment. This allows the CPU 1 to execute the same operation as that executed when the performance information conversion control program is stored in the ROM 2. This in turn facilitates the new installation, addition, or upgrading of the program. Alternatively, the music pattern data, the arrangement pattern data, and the performance information conversion control program may be stored in a floppy disk or a magneto-optical disk for example, from which they are supplied to the RAM 3 or the hard disk.

Alternatively still, the music pattern data, the arrangement pattern data, and the performance information conversion control program may be downloaded from a server computer through the communications interface 11 as well as the song data. In this case, the music arrangement apparatus is connected to the communications network 200 such as a LAN (Local Area Network), the Internet, or a telephone line for example, and the music pattern data, the arrangement pattern data, and the performance information conversion control program are subscribed from a server computer as well as the song data, which are then stored on the hard disk, upon which downloading operation completes.

The present invention is not limited to the tone-generator incorporated sequencer having the above-mentioned constitution. The present invention may also be applied to various electronic musical instruments of keyboard, string, wind, and percussion types. In addition, the present invention may be applied not only to electronic musical instruments incorporating a tone generator or automatic performance capability but also to equipment in which a tone generator, a sequencer, and an effector are made of discrete devices interconnected by MIDI or communications means such as various networks. Especially, in keyboard-type electronic musical instruments, the keyboard is utilized as the grid selector switches, thereby eliminating the necessity for dedicated switches.

In the above-mentioned embodiment, the present invention is applied to a sequencer. It will be apparent that the music arrangement apparatus according to the invention may be made up of personal computer and application software. In this case, CPU of the personal computer controls the system by means of OS installed on the hard disk for example and by use of a work area in a RAM. As with the above-mentioned embodiment of the invention, the music pattern data, the arrangement pattern data, and the performance information conversion control program are supplied as application software from an external storage medium or computer readable medium to the hard disk for example, by which the CPU controls the system in the same manner as with the above-mentioned embodiment. In this case, instead of the grid selector switches 75, predetermined keys of the keyboard of the personal computer may be used, and variables may be inputted by use of the numeric key pad for example. In addition, predetermined keys of the keyboard may be used for the selection of the music pattern data and tracks thereof.

It should be noted that the computer readable medium on which the performance information conversion control program is stored, such as the ROM, RAM, hard disk, CD-ROM, magnetooptical disk, DVD (Digital Versatile Disk), may be provided in the remote communications network server computer.

As mentioned above and according to the music arrangement apparatus of the present invention or the performance information conversion control program, the melody of the performance information can be changed or arranged, a sense of groove for example based on pitch change can be obtained, and a wide variety of performance can be executed with a simple operation. Further, any segment of the arrangement pattern data can be specified by use of the segment selecting block, and the arrangement data in the specified segment can be set by the arrangement data setting block. Consequently, the arrangement data of any segment can be simply set, thereby providing a wide variety of performance with a simple operation. Further, a plurality of segments can be simultaneously specified, allowing the user to execute a wide variety of performance with a simpler operation. Still further, the setting states of specified segments and arrangement data can be displayed, allowing the user to execute a wide variety of performance with a still simpler operation. Yet further, the sound components can be changed real time even during the performance reproduction based on performance information, allowing the user to execute a wider variety of performance.

What is claimed is:

1. A music arrangement apparatus comprising:

a music data block that provides a time-series of music data which contains at least a pitch component and which can be sequentially processed to produce a music performance;

an arrangement data block that provides a time-series of arrangement data that indicates a shift amount of the pitch component of the music data; and a modifying block that shifts the pitch component of the music data by the shift amount as indicated by the arrangement data so as to arrange the music performance.

2. A music arrangement apparatus comprising:

a music data block that provides a time-series of music data which contains at least a pitch component and which can be sequentially processed to produce a music performance;

an arrangement data block that provides a time-series of arrangement data in association with the time-series of the music data;

a modifying block that modifies at least the pitch component of the music data according to the arrangement data so as to arrange the music performance; and a generating block that sequentially processes the modified music data so as to generate a sound of the music performance, and a setting block manually operable even during the generating of the sound for setting the arrangement data so that the music performance is instantly rearranged during the generating of the sound.

3. A music arrangement apparatus comprising:

a music data block that provides a time-series of music data that can be sequentially processed to produce a music performance;

an arrangement data block that provides a time-series of arrangement data in association with the time-series of the music data, the arrangement data being divided into a sequence of segments;

a modifying block that modifies the music data according to the arrangement data so as to arrange the music performance;

a selecting block that selects one or more of the segments of the arrangement data; and a setting block that sets the selected segment of the arrangement data.

4. The music arrangement apparatus as claimed in claim 3, wherein the selecting block can select a group of consecutive segments at once.

5. The music arrangement apparatus as claimed in claim 4, further comprising a display block that displays the selected group of the consecutive segments such as to enable the setting block to visually edit and set the arrangement data.

6. The music arrangement apparatus as claimed in claim 3 further comprising a generating block that sequentially processes the modified music data so as to generate a sound of the music performance, and wherein the setting block can be manually operated even during the generating of the sound for editing the arrangement data so that the music performance is instantly rearranged during the generating of the sound.

7. A computer readable medium for use in a computer having a central processor and a memory, the medium containing program instructions executable by the central processor for causing the computer to perform a music arrangement process, wherein the music arrangement process comprises the steps of:

preparing a time-series of music data in the memory, the music data being composed of at least a pitch component and being sequentially processable to produce a music performance;

preparing a time-series of arrangement data that indicates a shift amount of the pitch component of the music data; and shifting at least the pitch component of the music data by the shift amount as indicated by the arrangement data so as to arrange the music performance.

8. A computer readable medium for use in a computer having a central processor and a memory, the medium containing program instructions executable by the central processor for causing the computer to perform a music arrangement process, wherein the music arrangement process comprises the steps of:

preparing a time-series of music data in the memory, the music data being sequentially processable to produce a music performance;

preparing a time-series of arrangement data in association with the time-series of the music data, the arrangement data being divided into a sequence of segments;

selecting one or more of the segments of the arrangement data;

setting the selected segment of the arrangement data; and modifying the music data according to the arrangement data so as to arrange the music performance.

9. A music arrangement method comprising the steps of:

providing a time-series of music data, which is composed of at least a pitch component and which can be sequentially processed to produce a music performance;

providing a time-series of arrangement data that indicates a shift amount of the pitch component of the music data; and shifting at least the pitch component of the music data by the shift amount as indicated by the arrangement data so as to arrange the music performance.

10. A music arrangement method comprising the steps of:

providing a time-series of music data, which can be sequentially processed to produce a music performance;

providing a time-series of arrangement data in association with the time-series of the music data, the arrangement data being divided into a sequence of segments;

selecting one or more of the segments of the arrangement data;

setting the selected segment of the arrangement data; and modifying the music data according to the arrangement data so as to arrange the music performance.

11. A music apparatus comprising:

means for providing a time-series of music data, which is composed of at least a pitch component and which can be sequentially processed to produce a music performance;

means for providing a time-series of arrangement data that indicates a shift amount of the pitch component of the music data;

means for shifting at least the pitch component of the music data by the shift amount as indicated by the arrangement data so as to arrange the music performance; and means for sequentially processing the modified music data so as to generate a sound of the music performance having the arranged melody.

12. A music apparatus comprising:

means for providing a time-series of music data, which can be sequentially processed to produce a music performance;

means for providing a time-series of arrangement data in association with the time-series of the music data, the arrangement data being divided into a sequence of segments;

means for selecting one or more of the segments of the arrangement data;

means for setting the selected segment of the arrangement data;

means for modifying the music data according to the arrangement data so as to arrange the music performance; and means for sequentially processing the modified music data so as to generate a sound of the arranged music performance.

* * * * *